United States Patent [19]

Gussler, Jr.

[11] 4,397,125

[45] Aug. 9, 1983

[54] SYSTEM FOR ALIGNING UNEVEN THICKNESS PANEL SECTIONS

[76] Inventor: Ova L. Gussler, Jr., 5045 Maid Marian Ct., Ashland, Ky. 41101

[21] Appl. No.: 156,385

[22] Filed: Jun. 4, 1980

[51] Int. Cl.[3] ..... E04F 13/08

[52] U.S. Cl. ..... 52/127.3; 52/389; 52/391

[58] Field of Search ..... 52/391, 390, 386, 387, 52/385, 509, 508, 127, 389, 126, 747, 127.3

[56] References Cited

U.S. PATENT DOCUMENTS

| | | | |
|---|---|---|---|
| 2,080,190 | 5/1937 | Sinner | 52/509 |
| 2,182,523 | 12/1939 | Markowski | 52/509 |
| 2,769,212 | 11/1956 | Hammitt | 52/509 |
| 3,129,531 | 4/1964 | Connor | 52/508 |
| 3,181,662 | 5/1965 | Maertzig | 52/509 |
| 3,223,415 | 12/1965 | Stengel | 52/126 |
| 3,990,199 | 11/1976 | Gallo | 52/509 |

FOREIGN PATENT DOCUMENTS

| | | | |
|---|---|---|---|
| 591613 | 9/1977 | Switzerland | 52/509 |

*Primary Examiner*—John E. Murtagh
*Assistant Examiner*—Henry E. Raduazo
*Attorney, Agent, or Firm*—Harvey B. Jacobson

[57] ABSTRACT

A system for installing and aligning the finished side of a floor, wall, ceiling or any flat surface formed from a plurality of panel sections secured to a support surface by an adhesive, to provide a uniform and even surface, regardless of the variation in thickness of the individual panels, comprises means for applying pressure on the finished side of at least two adjacent panels and means disposed between the adhesive and the rear surface of the panels to provide a pressure against the rear surface of the panel inversely proportional to the finished side pressure. The opposing pressures align the finished surfaces of adjacent panels to provide the uniform surface. The means for aligning the panels to form the uniform finished surface also provides a spacing system between adjacent panels and further holds the panels in position until the mastic, adhesive, etc., has hardened.

13 Claims, 11 Drawing Figures

SYSTEM FOR ALIGNING UNEVEN THICKNESS PANEL SECTIONS

BACKGROUND OF THE INVENTION

1. Field of the Invention

This invention relates to a system for the installation of floors, walls, ceilings, and any surface formed from a plurality of panels, and more particularly to a system of aligning the panels to provide a uniform and even finished surface regardless of thickness variations from panel to panel.

2. Disclosure Statement

Systems for installing walls, floors, ceilings, etc., from a plurality of panel members must enable the panel members to be formed into a uniform surface for aesthetic and functional purposes and must enable the individual panel members to be tightly secured to the support surface, regardless of the thickness variations which may exist from panel to panel. An example of a system for forming walls from a plurality of panels is U.S. Pat. No. 4,056,904, issued Nov. 8, 1977, to Dawdy, which discloses a system for temporarily holding panels of wallboard against support studs with adhesive therebetween, including an elongate semi-rigid rod removably affixed at one end of the stud, the other end projecting out from between the edges of two adjacent wall boards, and a retainer plate engaging the rod and pressing the wallboards against the stud, the engagement of the plate with the rod being such that the rod prevents the plate from moving away from the wallboard until removal is desired. Another system for alignment is disclosed in U.S. Pat. No. 4,024,683, issued May 24, 1977, to Kilian, wherein a fixing clamp having a rear plate and a front plate are used to form a free standing wall of tiles. The tiles are connected with the wall by pouring mortar or any other attaching material behind the tiles. The plates of the fixing clamp can include spring members for supporting the tiles if, as a result of tile thickness inaccuracies, some of the tiles are not as thick as the distance between the two plates of the fixing clamp. U.S. Pat. No. 3,309,587, issued Mar. 14, 1967, to Gilroy et al, discloses a bowling alley board adjustor which is applied to repair a bowling alley that comprises a depression in several of the boards used to form the surface of the bowling alley, the worn boards being lifted up from their support surface and then sanded uniform with the remaining alley surface. None of the above patents, however, discloses the method of the present invention whereby a plurality of panels are applied to a support surface and attached thereto by an adhesive, cement, etc., and which are aligned to form an even and uniform finished surface, even though thickness variations may exist from panel to panel.

SUMMARY OF THE INVENTION

This invention relates to the installation of floors, walls, ceilings, and any other surface which can be formed or covered by a plurality of panel members, such as ceramic tile, marble tile, and the like. The system used for installing the panel members or tiles is particularly useful for the installation of cultured marble, in that due to the nature of the manufacture of cultured marble, it is difficult to obtain accurate control of individual tile thickness and provide surfaces which are perfectly flat. Variations in thickness from tile to tile creates a problem in installation, in addition to a finished product that is uneven. The present invention provides for the alignment of panel members, including cultured marble tiles, regardless of the thickness variation which may exist between individual panel members, to enable the formation of a uniform and even finished surface.

In accordance with the invention, adjacent tile members are aligned to form a uniform finished surface by applying pressure against the finished surface of the tiles after the tiles have been placed on the attachment cement or adhesive and simultaneously applying a pressure against the rear surface of the tiles by a means placed between the tile and the attachment cement. The means to apply pressure on the rear surface of the tiles is so structured so as to apply a pressure inversely proportional to the pressure being applied to each tile on the front finished surface whereby adjacent tiles which may not be of the same thickness are either depressed or elevated relative to the base structure supporting the attachment cement. More specifically, the attachment material is applied to the base structure or support surface and a series of clip members are applied thereover in positions where adjacent tile members will be placed, each clip member comprising a resilient portion which is urged against the rear surfaces of the adjacent tile when laid and applies a rear surface pressure. Once the tile is laid, a pressure plate is urged against the front or finished surface of adjacent tiles. The resilient portion of the clips bend from the weight of the tile or lift the tile upward, depending upon the pressure being applied on the front finished surface from the pressure plate, thereby aligning adjacent tiles to form an even and uniform finished surface. The clip members also provide uniform spacing between adjacent tiles, which space can be filled with the grouting material once the tiles are aligned and set firmly in place in the attachment material. The present invention provides for two similar systems that can be used to align adjacent tiles of uneven thickness, each providing a specific spacing between the adjacent panel or tile members. In each case, the clip placed on the attachment material to apply the rear surface pressure is left in place and covered by the grouting material which fills the spaces between the adjacent tiles. The means to apply the pressure on the front or finished surface of the adjacent tile members, however, can be reused many times.

Accordingly, it is an object of the present invention to install floors, walls, ceilings, and the like, with a plurality of panel members and align the individual panel members to form an even and uniform finished surface.

It is another object of the invention to install and align a plurality of panel members used in the formation of floors, walls, ceilings, and the like to produce an even and uniform finished surface, regardless of any thickness variations which may exist from panel member to panel member.

A further object of the invention is to provide a system for holding the panel or tile members in position until the setting material which secures the tile to a support surface has hardened.

It is still yet another object of the invention to provide a system of installing and aligning panel and tile members onto a support surface to provide an even and uniform finished surface and provide a spacing system between adjacent tile members.

Yet another object of the invention is to provide a system for installing and aligning tile members to produce an even and uniform finished surface in which most of the system materials can be reused.

Still yet another object of the invention is to provide a system for installation of very large floor panels or wall panels on uneven floors, walls, etc., wherein the panels can be installed to follow the unevenness of the floors or walls and still have the adjacent edges of the individual panel members be even with each other.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3-A illustrates the placement of the clip member of the present invention which includes the resilient flanges which provide the rear side pressure to produce the uniform finished surface, the figure showing four tiles being aligned and including a cutout portion to illustrate the orientation of the resilient flange of the clip member.

DETAILED DESCRIPTION OF THE INVENTION

Figure 1:
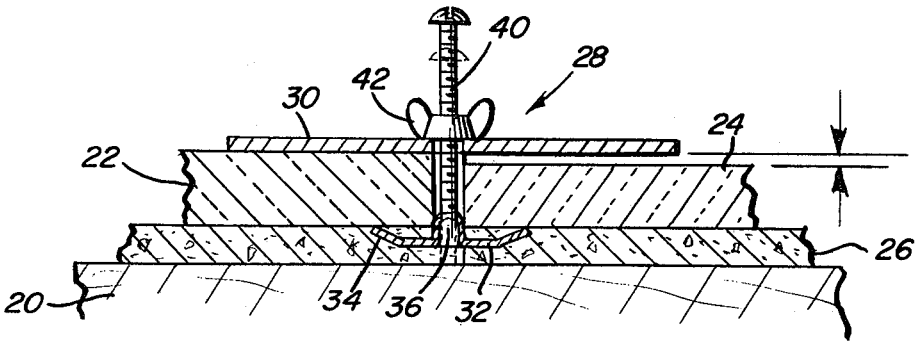
FIG. 1 is a sectional view illustrating two adjacent tiles being aligned by the system of the present invention, the two tiles having different thicknesses.
Figure 2:
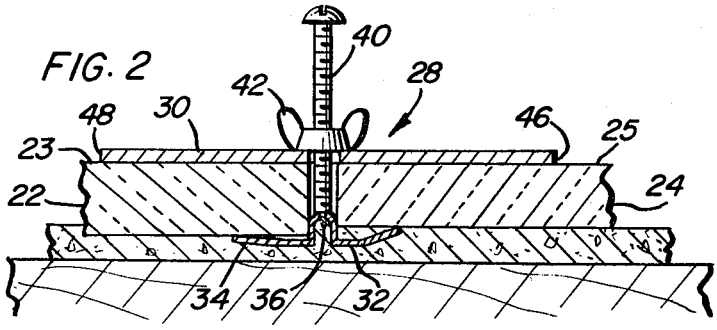
FIG. 2 is a sectional view illustrating how the system shown in FIG. 1 aligns two adjacent tiles of different thickness to produce an even and uniform finished surface.

Referring to FIGS. 1 and 2, a support surface 20 of concrete or wood is to be covered with a plurality of panel or tile members such as 22 and 24 which differ in thickness by the amount indicated in FIG. 1. In order to install the tile members, a layer of mastic, inorganic cement, or organic adhesive 26 is uniformly applied over support surface 20 in order to permanently attach tile members 22 and 24. The panel or tile members 22 and 24 can be selected from a variety of materials including paperboard, wood, ceramic tile, marble tile, etc. During the manufacture of some of these materials, it is difficult to obtain a set of such panel or tile members in which all the members are of the same thickness. Thus, when such tiles are being installed to form a floor, wall, ceiling, or the like, much time is required to align the tiles so that a uniform and even finished surface will be produced. In many instances the end result is a finished surface which is uneven, non-uniform, lacks in aesthetic value and in some cases may even reduce the functional use of the surface. The present invention provides a system for installing and aligning panel or tile members, including panel members which vary in thickness from panel to panel, in an easy and efficient manner to provide an even and uniform finished surface. The aligning system of the invention is designated by numeral 28 and comprises opposing pressure members 30 and 32 placed on opposite sides of at least two adjacent tile members.

To install panel or tile members 22 and 24, at least one pressure member 32 is placed on the adhesive layer 26 so that at least one resilient flange 34 of pressure member 32 will contact the rear surface of each of the tile members. Loop 36 formed in pressure member 32 provides a spacer between tile members 22 and 24. Once pressure member 32 is in place, each tile member 22 and 24 is placed on adhesive layer 26 so as to be juxtaposed on resilient flange 34 and adjacent opposite sides of loop spacer member 36. Pressure member 30 is then placed over the two adjacent tiles and a continuous pressure is applied against the front surface of pressure member 30 and thus against tile members 22 and 24. As can be seen in FIGS. 1 and 2, tile member 22 is thicker than tile member 24 and as such a greater amount of pressure is applied to the tile of greater thickness, in this case tile 22, which results in tile 22 pushing resilient flange 34 to the flattened condition shown in FIG. 2, while the resilient flange under tile 24 exerts an upward pressure on the rear surface thereof until the front surfaces 23 and 25 of tiles 22 and 24, respectively, are in alignment. As is clear from the drawings, the amount of pressure applied by pressure member 32 and, in particular, resilient flanges 34 on each tile will be inversely proportional to the pressure applied on each tile by pressure member 30, the thicker tile being pressed by pressure member 30 in greater amounts and therefore pressing resilient flange 34 into a more flattened condition than the flange 34 under the less thick tile which maintains its pressure contact against the rear surface.

Figure 3:
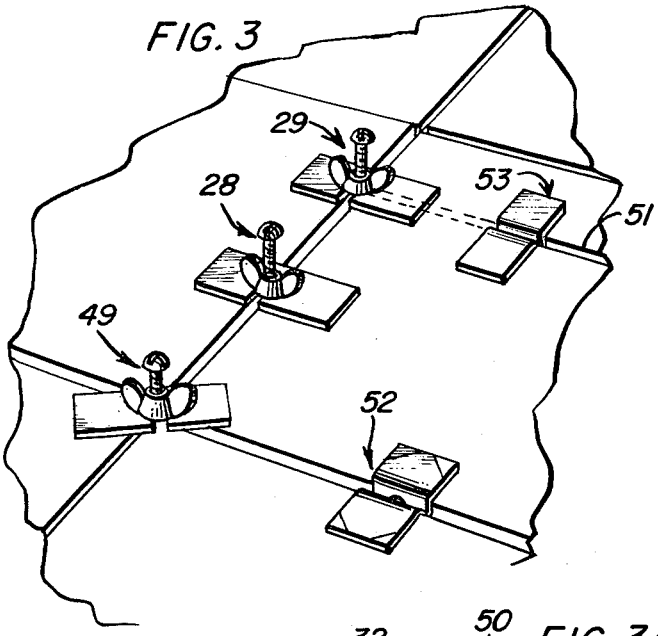
FIG. 3 is a perspective view illustrating the placement of the alignment system of the present invention and further showing how individual members of the system can be used as a spacing means only.
Figure 4:
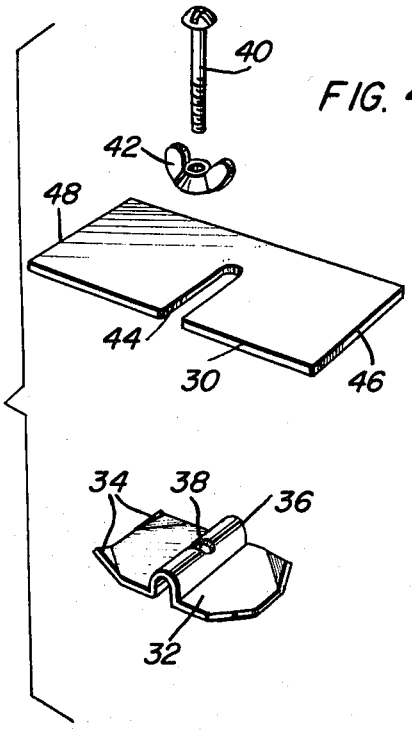
FIG. 4 is an exploded perspective view illustrating the individual components of the alignment system illustrated in FIGS. 1 and 2.

As illustrated in FIG. 4, pressure member 32 is a clip which contains four corner resilient flanges 34 and loop spacer member 36 placed in the center. Spacer member 36 contains aperture 38 to receive the pressure applying means which is in the form of bolt 40 and wing nut 42. Pressure member 30 is a plate containing a notch 44 able to receive bolt 40. As wing nut 42 is turned down around bolt 40, it exerts a pressure against plate 30 which is translated to the tile members and to the resilient flanges 34 of clip 32. An important consideration in installing and aligning a group of individual panel or tile members in accordance with the system of the present invention is to insure that at least one end 46 or 48 of pressure plate 30 is situated on a flat surface, as shown in FIG. 3, as opposed to both ends being placed in the joints between adjacent tile members. The alignment system 28 of the present invention can align more than two tiles at once as indicated by alignment systems 29 and 49 in FIG. 3, each resilient flange 34 of clip 32 being placed against the rear surface of a different tile. In a four tile alignment, a modified form of spacing loop 36 may be needed to provide a uniform spacing adjacent all tiles. In some instances, it may be necessary to lift all the tiles resting on pressure member 32. This can be accomplished by turning bolt 40 so that it presses against support 20, as shown by the dotted line in FIG. 1. In situations where one tile member is significantly greater in thickness than another, resilient flange 34 can be bent by hand to provide the proper alignment pressure. As soon as the tiles are aligned so that the finished surface formed by the tiles is even and uniform, and as soon as attachment material or adhesive 26 has hardened to permanently set the tiles in place, wing nut 42 can be loosened, pressure plate 30 can be slipped away from bolt 40 and the bolt and nut assembly removed leaving the adjacent tiles and pressure member 32 in place. Finishing the tile surface involves the conventional step of filling the space between adjacent tiles with grouting material which will cover loop spacer member 36.

Pressure member or clip 32 can be placed upside down and used as a spacer, only as indicated by reference numeral 52, including a spacer for staggered tiles forming joint 51, as indicated by reference numeral 53 in FIG. 3.

While not intending to limit the invention in any way, preferred dimensions of each component of the system 28 for installing and aligning $12\times18\times\frac{1}{2}''$ cultured marble tile involves the use of a pressure plate 30 formed of a steel or aluminum plate 3" long and $1\frac{1}{4}''$ wide with a plate thickness of about $\frac{1}{8}''$. Groove 44 formed in plate 30 is preferably $\frac{3}{4}''$ long and 3/16" wide. Pressure member or clip 32 is formed of steel about 0.025" thick and $1\frac{1}{4}''$ square. The height and width of spacer loop 36 being about $\frac{1}{8}''$ and resilient flanges 34 being oriented up about 1/16" from the horizontal.

Figure 5:
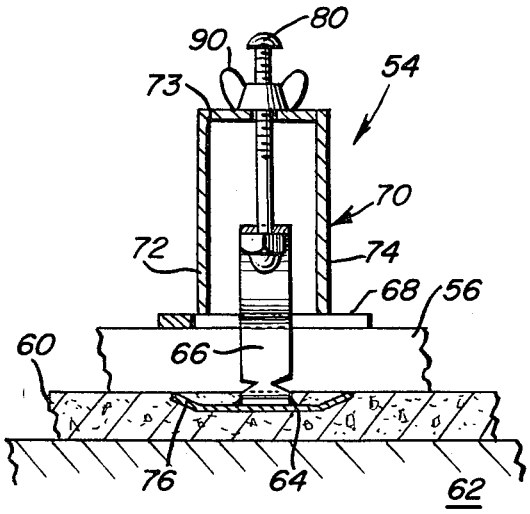
FIGS. 5 and 6 are sectional views illustrating a modified form of the alignment system which constitutes a second embodiment of the present invention.
Figure 6:
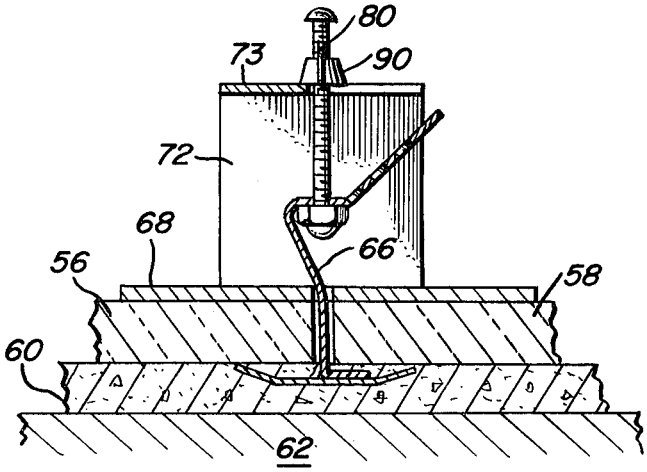
Figure 7:
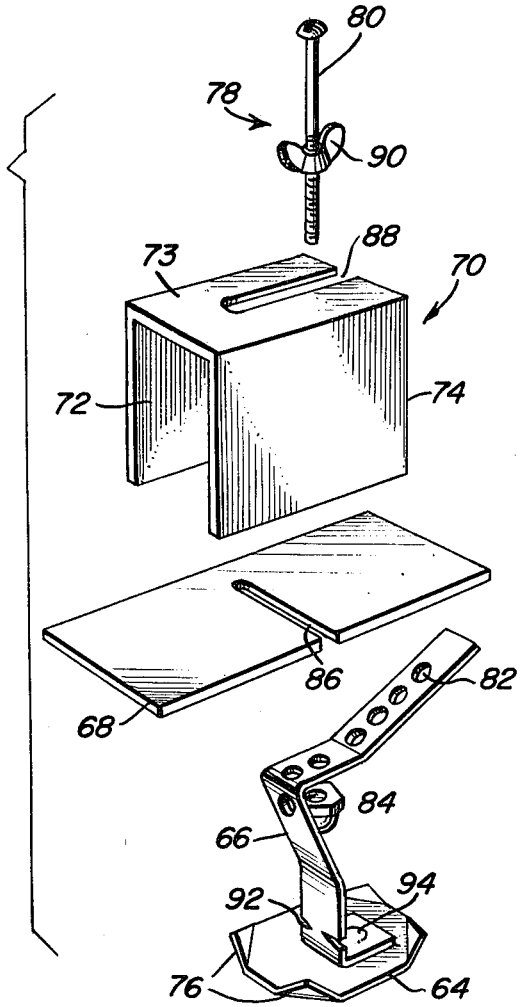
FIG. 7 is an exploded perspective view of the alignment system shown in FIGS. 5 and 6.
Figure 8:
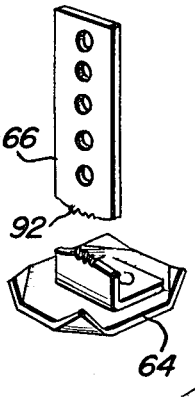
FIG. 8 is a perspective view of the clip member used in the modified form of the invention illustrating the spacer means which can be broken off once the tiles or panel members are aligned.

FIGS. 5, 6 and 7 illustrate a second embodiment of the invention which can be used to install and align panel or tile members to produce a uniform finished surface. This alignment system designated by reference numeral 54 is similar to aligning system 28 in that pressure is exerted on the front or finished surface and rear surface of tiles 56 and 58. In using system 54, adhesive 60 or the like is applied to wood or concrete support surface 62 which can be a wall, floor, ceiling, or any substantially flat surface structure. Once adhesive layer 60 has been applied, pressure member or clip 64 is placed and aligned along the adhesive 60 to provide the proper spacing of adjacent tile members. The principal difference between aligning systems 28 and 54 involves the difference between the spacer members secured to pressure clips 32 and 64. Spacer 66 of pressure clip 64 is a thin strip welded or otherwise secured to the base of clip 64 and is able to form very small joints between tile members. The system for applying pressure on the front surface of each tile member is also modified in the second embodiment in which a pressure plate 68 is acted upon by a U-shaped pressure member 70 which can accommodate spacer 66 between side walls 72 and 74. To align tiles 56 and 58, pressure is applied to pressure member 70 which urges plate 68 against the front surface of the tiles, resilient flanges 76 of pressure clip 64 being bent according to the pressure which is being applied, in the equivalent member as flanges 34 in system 28. As shown in FIG. 7, the means to apply the pressure utilizes the bolt and wing nut arrangement 78 in which bolt 80 is placed through aperture 82, one of a series of apertures placed along spacer 66, bolt 80 being secured by nut 84. Plate 68 containing groove 86 is slipped around spacer 66 and placed on the front surface of the tile members. Pressure member 70 is slid around bolt 80, groove 88 accommodating bolt 80 and placed so that the bottom surface of each side wall 72 and 74 is firmly positioned on plate 68. Tightening of wing nut 90 provides the pressure on pressure member 70 and pressure plate 68 to align the tiles. Once the front finished surfaces of the tiles are aligned, pressure members 70 and 68 can be removed along with nut and bolt assembly 78. A unique feature of this embodiment of the invention is that spacer 66 is provided with notches or undercut portions 92 which enable spacer 66 to be broken off near the base of pressure clip 64 as shown in FIG. 8 by a back and forth or twisting movement. The spaces between adjacent tile members can then be filled with grouting material covering clip 64 and the remaining portion of spacer 66.

Figure 3A:
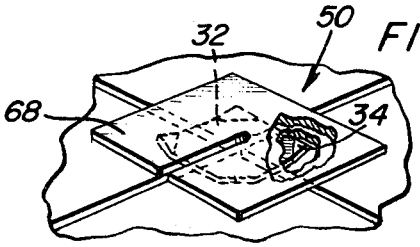

Preferred dimensions for the components of the second embodiment of the invention should not be so construed so as to limit the usefulness of the invention using slightly altered sized components. Clip 64 formed from steel is $1\frac{1}{4}''$ square, the corner resilient flanges oriented about 1/16" from the horizontal. Spacer element 66 formed from steel or aluminum can be spot-welded, such as at 94, to clip 64 and is about $1\frac{1}{2}''$ long. The critical feature of spacer 66 is its width which is about 1/16" and is used to form very small joints or spaces between tile members as opposed to spacer 36 on pressure clip 32 which is used to form joints of $\frac{1}{8}''$ or greater. Pressure plate 68 is the same as plate 30 shown in FIG. 4. U-shaped pressure member 70 is formed from side members 72 and 74 having square edges of $1\frac{1}{2}''$ while top face 73 is $\frac{5}{8}''$ wide. Alignment system 54 can also be used with a four-corner alignment, as shown at 50 in FIG. 3A, in which case pressure plate 68 would be a $2\frac{1}{2}''$ square plate with a 1/16" spacer member 66. In this four-corner alignment, all corners of plate 68 would rest on a flat surface of the tiles and the ends will cross the joints between tiles.

Figure 9:
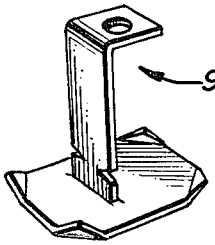
FIG. 9 is a perspective view of the clip member used in the modified form of the invention which comprises a spacer and pressure means formed from one piece of material.
Figure 10:
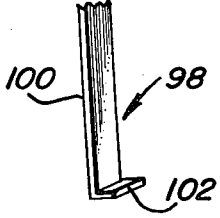
FIG. 10 is a perspective view of an auxiliary component of the alignment system which can be used to apply leverage to the tile members for further alignment, if needed.

An alternative to spot-welding spacer 66 to pressure clip 64 is shown in FIG. 9 wherein a combination pressure member and 1/16" spacer designated as numeral 96 is of one-piece construction formed by metal extrusion.

An auxiliary component of either alignment system 28 or 54 is leverage bar 98 including handle member 100 and tongue 102. Leverage bar 98 is utilized to lift up any tiles in the event the alignment systems do not accurately align the finished surface of the tiles to form an even and uniform surface. Tongue 102 can be slipped through the space between two adjacent tiles and underneath the rear surface of the tiles to provide upward leverage and lift the tile uniform with an adjacent tile member. Handle member 100 is about $8\frac{1}{2}''$ long while tongue 102 usually extends no further than 1/16" from the base of handle 100.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a support surface over which a plurality of individual side-by-side slightly spaced apart panel members are supported in a floating manner upon a variable thickness layer of attaching material disposed on said surface between the latter and said panel members, a system for alignment of said panel members whereby front surfaces thereof opposite the rear surfaces of the panel members contacting said attaching material may be positioned in substantially coplanar relation, said system including a first pressure member having front and rear sides corresponding to said front and rear surfaces including a central portion and remote portions spaced apart on opposite sides of said central portion, said first pressure member being disposed to the rear of adjacent marginal portions of said panel members with said front side facing forwardly and said remote portions registered with the rear surfaces of said adjacent panel members spaced from said adjacent marginal portions and said central portion registered with the space between said adjacent marginal portions of said adjacent panel members, a second pressure member overlying and including abutment surfaces abuttingly opposing adjacent front surface portions of said adjacent panel member marginal portions, and elongated connecting means operatively connected between said central portion and a central area of said second pressure member, extending through said space and operative to adjustably draw said central portion toward said second pressure member, said remote portions being resiliently supported from said central portion and yieldingly resisting movement thereof, relative to said central portion, in a direction away from said second pressure member, said system being supported entirely from said adjacent panel members.

2. The system of claim 1 wherein said first pressure member central portion includes a spacer member for reception and defining minimum spacing between said adjacent panel members.

3. The system of claim 2 wherein said spacer member is formed as an integral part of said central portion and wherein said first pressure member includes means for contacting at least two adjacent panel members on each side of said spacer member.

4. The system of claim 2 wherein said first pressure member comprises a flat base and resilient flanges extending from said base in contact with the rear surfaces of said adjacent panels and said spacer member comprises an upwardly projecting loop carried by said base member.

5. The system of claim 4 wherein said spacer member and said first pressure member are one piece formed by a process extrusion metal.

6. The system of claim 1 wherein said second pressure member includes generally planar surface means opposing and contacting said front surfaces and said remote portions include upraised flanges which contact the rear surfaces of said adjacent panel members and are able to be bent toward the plane of the base by downward force on said pressure member.

7. The system of claim 6 wherein said generally planar surface means is a quadralateral polygon having corners and said extended flanges are disposed at the corners of said generally planar surface means.

8. The system of claim 1 wherein said second pressure member to apply pressure to the front surface of said panels includes a flat plate which contacts the front surfaces of said at least two adjacent panels.

9. The system of claim 8 wherein said connecting means includes means operative to adjust the spacing between said first and second pressure member.

10. The system of claim 9 wherein said second pressure member includes means positioned below said plate to form a space between said adjacent panel members, said connecting means including bolt means passing through said plate and anchored to said spacer means and a wing nut rotatably mounted on said bolt to contact said plate.

11. The system of claim 1 wherein said second pressure member includes a U-shaped member including a top face and two sides, said connecting means including bolt means passing through said U-shaped member and said plate, and a wing nut rotatably mounted on said bolt to contact said U-shaped member, said two sides of said U-shaped member contacting said flat plate, said system further including member carried by said first pressure member and positioned below said flat plate to form a space between adjacent panel members.

12. The system of claim 11 wherein said spacer means comprises a thin strip attached to said first pressure member, the thickness of said strip forming the space between said adjacent tile members, said flat plate having an aperture therein to receive a portion of said strip extended above said panel members, said bolt passing through an aperture in said strip and anchored thereto by a nut.

13. The system of claim 12 wherein said strip includes an under cut portion along its width adjacent to the first pressure member whereby said strip can be broken at said under cut portion by bending or twisting of said strip.

* * * * *